United States Patent [19]

Vincent

[11] 4,117,313

[45] Sep. 26, 1978

[54] CALCULATOR FOR LAYING OUT PARKING LOTS

[76] Inventor: Richard T. Vincent, 9144 S. Hamlin Ave., Evergreen Park, Ill. 60642

[21] Appl. No.: 759,261

[22] Filed: Jan. 14, 1977

[51] Int. Cl.[2] ..... G06C 3/00; G06G 1/14

[52] U.S. Cl. ..... 235/61 GM; 33/1 SD; 235/85 R; 235/89 R

[58] Field of Search ..... 235/61 GM, 61 B, 85 R, 235/89 R, 127, 77; 33/1 SD, 1 G, 1 F, 1 AA

[56] References Cited

U.S. PATENT DOCUMENTS

| | | | |
|---|---|---|---|
| 1,560,963 | 11/1925 | Art | 235/85 R |
| 3,339,838 | 9/1967 | Skuderna | 235/61 GM |
| 3,559,881 | 2/1971 | Maison | 235/89 R |
| 3,812,586 | 5/1974 | Itokawa | 33/1 SD |

*Primary Examiner*—Stephen J. Tomsky

*Attorney, Agent, or Firm*—Leydig, Voit, Osann, Mayer & Holt, Ltd.

[57] ABSTRACT

A calculator for facilitating the layout of parking lot stalls of desired length and width at a desired angle. The calculator includes a first member having orthogonal length and width scales as well as angle indicators relating to desired stall angle. A second member is pivotable on the first, and includes indicia related to desired stall length and width. The second member is positioned for pivoting on the first, is aligned according to the desired stall data to provide a direct readout of the orthogonal length and width dimensions necessary to lay out the stalls.

6 Claims, 4 Drawing Figures

20
21
22
23
30
40
41
43
50
51
52
55
60
80
85
88
90
92
94
100
101
90°
80°
70°
60°
50°
45°

9' STALLS
20' LONG × 70°

CALCULATOR FOR LAYING OUT PARKING LOTS

This invention relates to mechanical calculators, and more particularly to such a device for calculating striking dimensions in laying out parking lot stalls.

More and more parking lots are being laid out to accurately define the area available for each parked vehicle by painting lines on the surface of the lot to define respective parking stalls. If space is no problem, the stalls may be laid out at right angles to the base line, in which case it is not difficult to rule the lot before painting to define the desired stall lengths and widths. However, when space becomes a problem, it is often necessary to lay out the stalls at an angle, to provide the necessary stall length in the available space and to allow easy ingress and egress. Laying out of a parking lot for the purposes of maximizing the number of stalls, or providing a desired number of stalls of a specified length and width at a specified angle is not an easy task. In the typical case, surveying equipment is not available, and the workers are left to experiment or guess in order to approximate the desired stall angle. As can be expected, an inordinate amount of time is usually expended in laying out the first stall in a bay. Whether there will be wasted space at the end of the bay is often not determined until the final stall line is struck.

In view of the foregoing, it is a general aim of the present invention to provide a calculator for simplifying the layout of parking lots by calculating orthogonal dimensions related to the axis of the lot which may be easily and accurately laid out.

In carrying out that aim, it is an object of the invention to provide a calculator for laying out stalls in a parking lot, which relates desired stall length, width and angle to orthogonal dimensions associated with the axis of the lot, so that the stalls may be accurately laid out using no more than a simple measuring tape and marker. In that regard, it is an object to provide such a calculator which is simple to use, and which, when adjusted for a particular problem, provides a readout of all of the necessary orthogonal dimensions with a single setting so as to allow flexibility in tailoring the stall dimensions to the dimensions of the particular lot.

Other objects and advantages will become apparent with reference to the following detailed description when taken in conjunction with the drawings in which.

Figure 1:
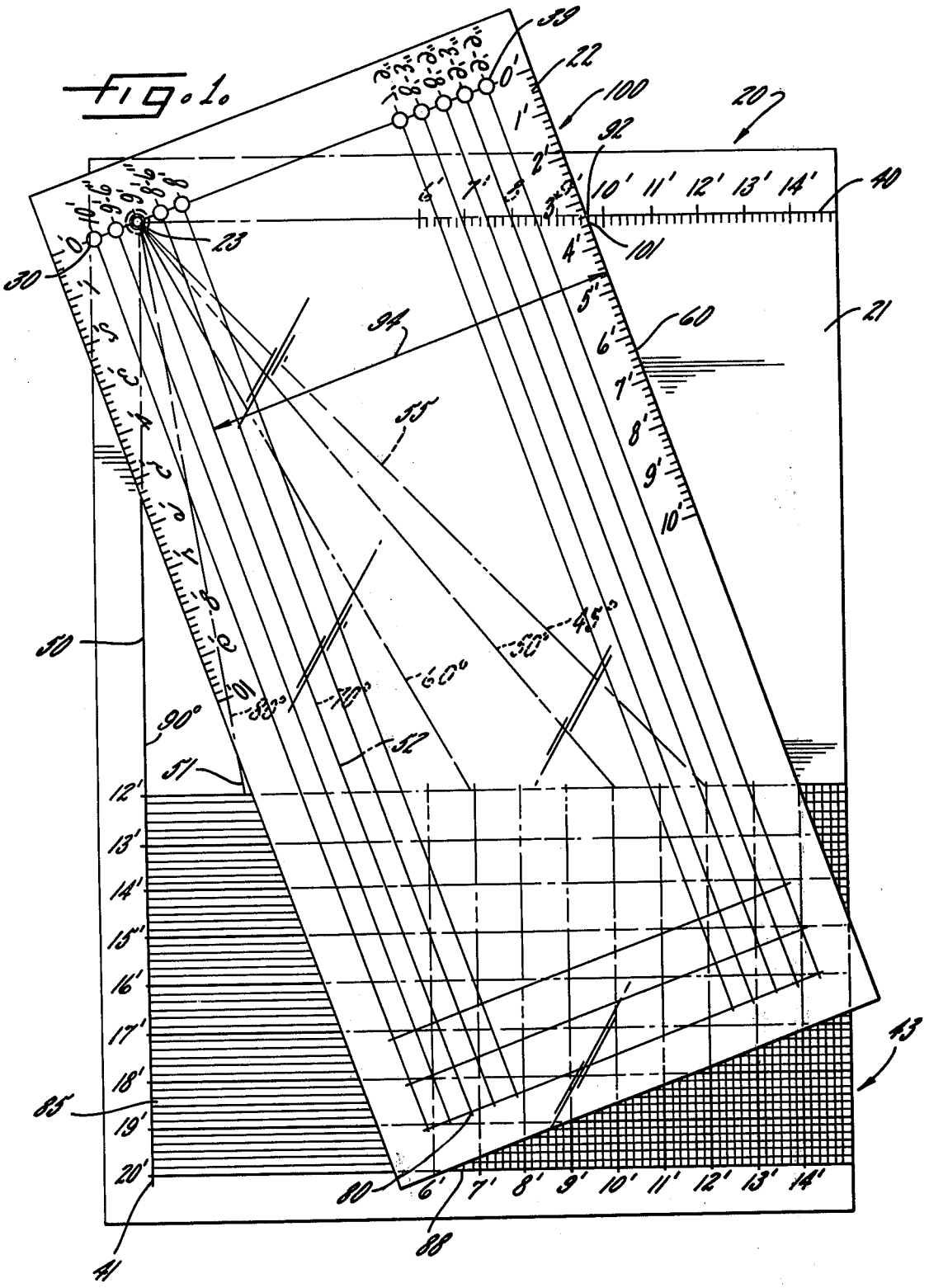
FIG. 1 is a plan view showing a calculator constructed in accordance with the present invention.
Figure 4:
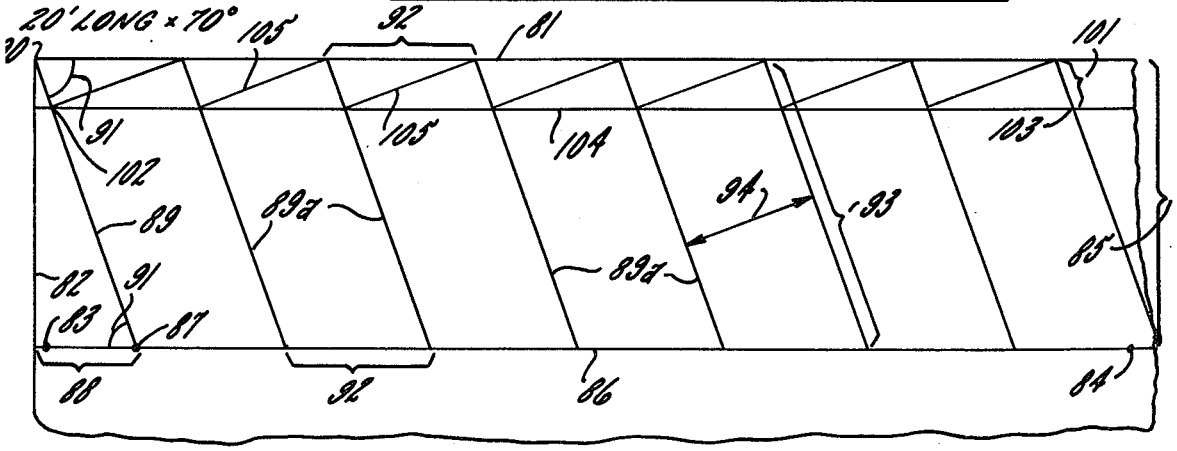

FIG. 4 schematically illustrates a parking lot laid out with the calculator as adjusted in FIG. 1.

While the invention will be described in connection with a preferred embodiment, there is no intent to limit it to that embodiment. On the contrary, the intent is to cover all alternatives, modifications and equivalents included within the spirit and scope of the invention as defined by the appended claims.

Turning now to the drawings, FIG. 1 shows the assembled calculator 20 comprising a pair of scale carrying members, namely a lower member 21 and an upper member 22. In order to allow reading of the scales on the lower member through the upper member, at least the upper member should be made of transparent material such as plexiglas. Conveniently, both members may be made from this material. The members are pivotable with respect to each other, such function in the present instance being achieved by a pivot pin 23 affixed to the lower member 21 engageable with one or more apertures 30–39 in the top member 22. As will become more apparent, setting the calculator up to solve a particular problem (such as the layout of FIG. 4) involves positioning of one of the apertures 30–39 over the pivot pin 23 and rotating the top member 22 with respect to the base 21 according to a set of desired conditions in order to calculate layout dimensions. It should be noted that FIG. 1 shows the calculator at about actual size, indicating that the instrument is sufficiently small to be easily carried and manipulated, but large enough to be accurately read.

Figure 2:
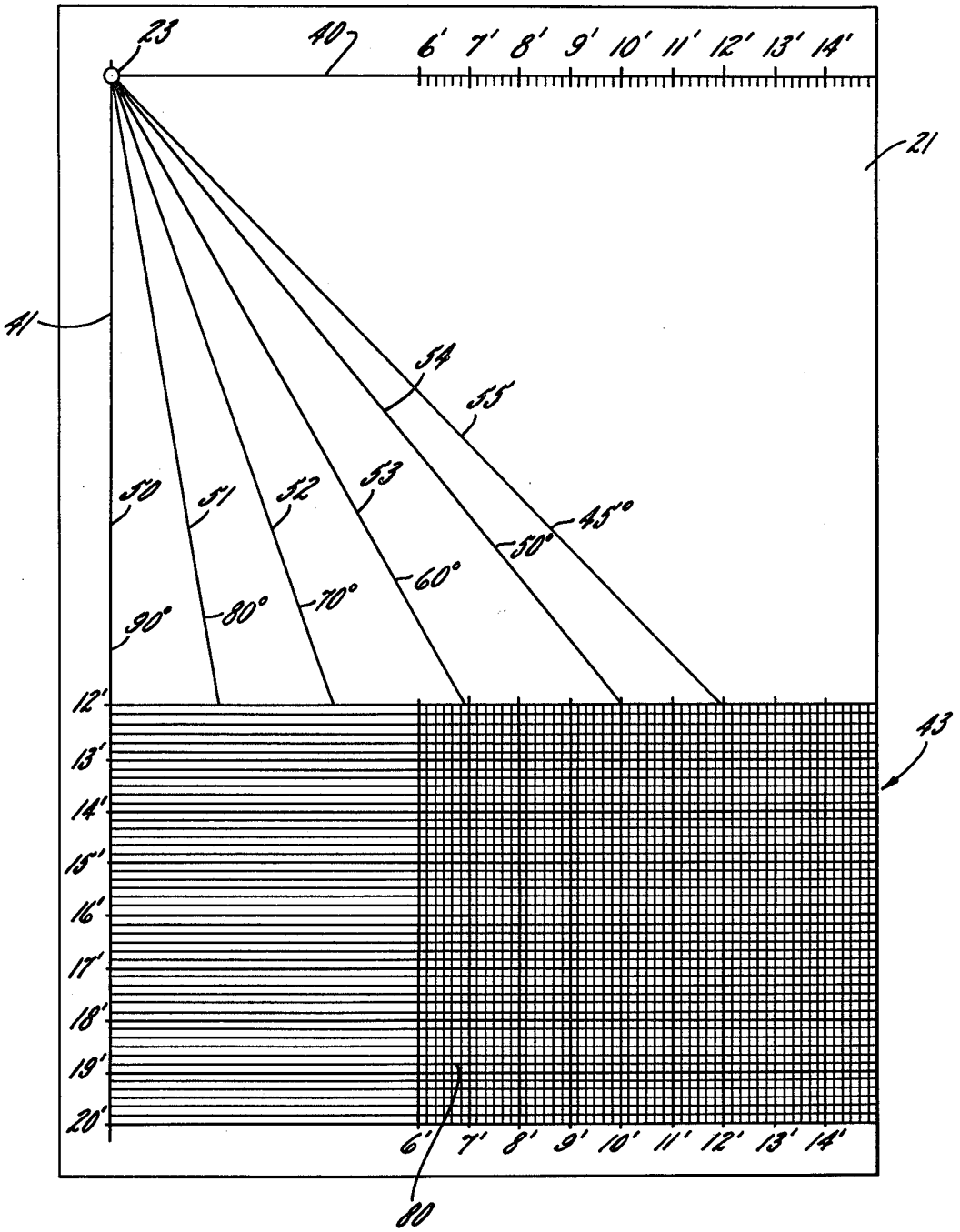
FIG. 2 shows the lower member of the calculator of FIG. 1.

Referring to FIG. 2, the lower member 21 is shown in greater detail, including the pivot pin 23 located at the origin of a pair of orthogonal axes formed of base lines 40, 41. Both axes are graduated in terms of lineal measure, in the present instance in terms of feet and inches, with graduated indicia emanating from the axes forming a grid 43 covering at least a portion of the lower member 21. The scale along the axis 40, as well as the corresponding scale in the grid 43 are used to read the calculated orthogonal width dimensions 88 and 92 (to be described below). The scale along the axis 41 as carried into the grid 43 is used to read calculated orthogonal length dimensions 85 (which will also be described below). A series of angle indicia 50–55 emanate from the origin 23 toward the grid 43, and are calibrated in terms of desired stall angle. It is seen that any point on the grid defines a particular length and width dimension, for example the point labeled 80 indicating a length of 18 feet-8 inches and a width of 6 feet-9 inches.

Figure 3:
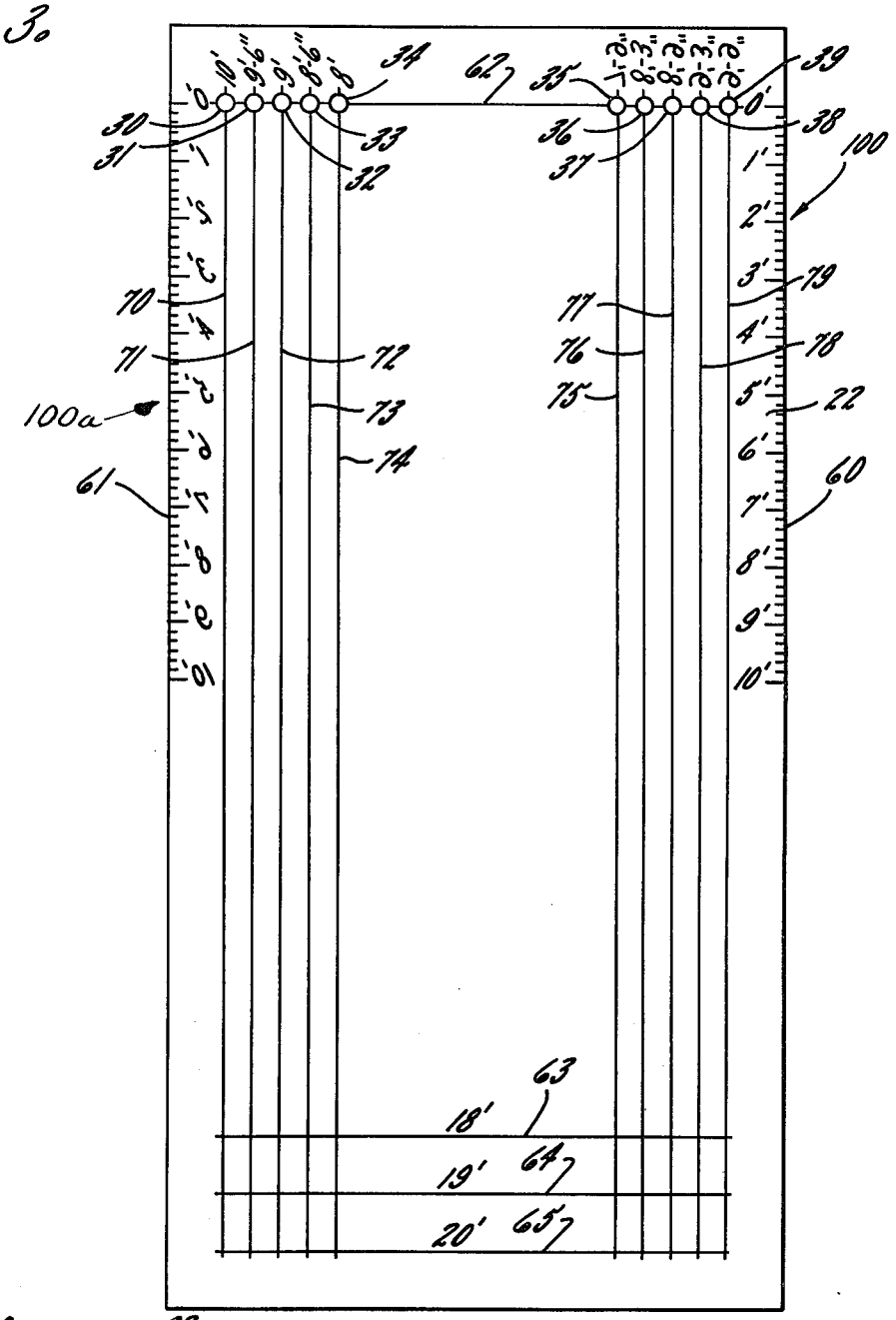
FIG. 3 shows the upper member of the calculator of FIG. 1.

Turning now to FIG. 3, there is shown in detail the upper member 22 which carries scales related to desired stall dimensions. In the illustrated embodiment, the upper member includes a plurality of apertures 30–39 located with respect to indicia on the scale (in this case one of the scale edges) to establish a desired stall width. The apertures 30–34 are related to the edge 60 for stall widths indicated adjacent the respective apertures. Similarly, the apertures 35–39 are related to the edge 61 for stall widths indicated adjacent those apertures. For example, if a stall width of 9 feet is desired, the aperture 32 is positioned over the pivot pin and the edge 60 serves as the indicator for this stall width. As suggested by the reversed numerals adjacent the apertures 35–39, when these apertures are used, the scale is flipped over to associate a selected one of the apertures with the pivot point, the edge 61 then becoming the reference indicator.

A further scale on the upper member comprises a series of lines 63, 64, 65 graduated in terms of desired stall length. The apertures 30–39 fall in a straight line 62 which may be termed a "zero length line", or the base line in a 90° situation. The lines 63, 64, 65 are parallel to line 62 and scaled therefrom so as to be related to common desired stall lengths of 18, 19 and 20 feet. Emanating from the apertures 30–39, and running perpendicular to the lines 62–65 are a series of lines 70–79 which comprise alignment means for aligning the upper member with a desired angle on the lower member for calculating the orthogonal striking dimensions.

It should be noted that the width scale on the upper member 22 may be configured with only a single pivot point, and indicia in the form of lined graduations on the scale provided for the various desired stall widths. For example, if the aperture 30 is taken as the sole pivot point, and in the scale given, the reference line 79 would become the 9 foot indicator, the reference line 78 the 8 foot-6 inch indicator, and so on. Additional intermediate indicators would be ruled, in relationship to the sole pivot point, to cover the entire desired scale graduated in the appropriate increments.

Operation of the calculator 20 for laying out a parking lot, will be described with reference to FIGS. 1 and 4. Initially, it is necessary to define or determine the initial conditions. In the instant example the initial conditions will be defined as 9 by 20 foot stalls angled at 70°. As shown in FIG. 1, the upper member 22 is positioned with the 9 foot width aperture 32 over the pivot pin 23 to accommodate a first of the requirements. The line 72 emanating from the aperture 32 is then aligned with the desired angle line 52 (the 70° line) on the lower member by rotating the upper member to the position illustrated in FIG. 1, thereby to define the second requirement. In this position, and without further adjustment, all of the dimensions necessary to lay out the stall pattern illustrated in FIG. 4 are determined. Three dimensions are read from the calculator as thus adjusted. The intersection of the angular alignment line 72 and the desired length line 65 (the 20 foot line) defines a point 80 which when transferred to the grid 43 determines the orthogonal length on the length scale 41 and the initial or partial width necessary to establish the desired angle on the width scale 40. Reading such scales in the present example yields an orthogonal length 85 of 18 feet-8 inches and an initial or partial width 88 of 6 feet-9 inches. The intersection of the width indicator (the edge 60) with the axis 40 defines the repetitive stall width 92, in the instant example read as 9 feet-8 inches.

To use this calculated data to lay out the stall array, the dimensions are transferred to the lot itself, illustrated schematically in FIG. 4. The lines 81 and 82 are the base references along which the stalls are to be laid out, and may be considered analogous to the base lines 40, 41. These may, for example, be the boundaries of a lot, bordering walls, an adjacent stall bay, or the like. The orthogonal length dimension 85, calculated above as 18 feet-8 inches, is measured perpendicularly from the base line 81 at 2 or more points 83, 84. A chalk line is snapped to connect these points, and thus defines end line 86, establishing the orthogonal bay length. It is then necessary to establish the stall angle, which is done simply by measuring the partial width 88, calculated above as 6 feet-9 inches, from and perpendicular to the base line 82, along the line 86, to define a point 87. A chalk line 89 is then snapped from the point 87 to the intersection 90 of the base lines 81, 82. The line 89 thus constructed is the first stall line and intersects the base line 81 (as well as the end line 86) at an angle of 70°, indicated at 91. Following the construction of the first stall line 89, it is simply necessary to mark off the repetitive stall width 92 along the base line 81 and the end line 86. In other words, all that is involved is simply repeating the 9 foot-8 inch dimension along the lines 81, 86. Using chalk lines to connect associated points results in the layout of the remaining stall lines **89*a***. The array thus laid out is then painted to complete the job.

It is emphasized that using the calculated orthogonal striking dimensions rather than the desired dimensions, all measurements on the lot are made either along defined axes or in right angle relationship thereto. The desired stall angle is achieved with precision, approximation and guesswork being eliminated. In the foregoing illustration the stall lines 89, **89*a* are each 20 feet in length, indicated by the segment 93. The distance between adjacent stall lines measured on a line 94** perpendicular thereto is precisely 9 feet. The difficulty in laying out the desired dimensions directly will now be apparent.

While the foregoing is sufficient to illustrate the operation of a calculator constructed in accordance with the invention, the following will emphasize its flexibility. In many situations the desired length, width and angle are not predetermined, but must be calculated to achieve a particular requirement, such as the maximum number of stalls in a given area. One situation commonly encountered involves the layout of stalls in an area insufficient to accommodate two bays and an adequate aisle when the stalls are laid out perpendicularly. It is noted that a 18 to 20 foot aisle is generally considered to be the "standard aisle". Thus, if 20 foot stalls are desired, and the total dimension available for the two bays and an aisle is, for example, 54 feet, the stalls must be ruled at some angle. Knowing the lot dimensions, the calculator is used not only to calculate the necessary angle, but also the orthogonal dimensions necessary for achieving such angle. Furthermore, the calculator may be manipulated to "fine tune" the calculated dimensions for maximizing the number of stalls and to eliminate wasted space at the end of the bay.

For example, if two bays and an aisle are required in a lot of given width, the aisle width is subtracted from the lot width, and the remainder divided by 2 to determine the orthogonal length available for each bay, the dimension previously referred to as 85. The upper member 22 is then installed on the base 21 with a "nominal width" aperture over the pivot pin 23 to make an initial calculation. The upper member 22 is rotated with respect to the base member 21 until the desired length line (at the point it intersects the line emanating from the nominal width aperture) intersects the available bay length dimension 85 on the grid 43. This determines the stall angle, as well as the initial width dimension 88 for achieving this angle. Also determined is the orthogonal repetitive width 92 for laying out the entire bay. The initial width dimension 88, may then be subtracted from the total length of the base line 81 to determine the dimension available for accommodating stalls. This dimension may be divided by the repetitive stall width 92 to determine the number of stalls which may be accommodated. The desired stall length and width may then be adjusted accordingly to fit the maximum number of stalls into the available area. This "fine tuning" of stall width to fit the lot dimensions becomes even simpler with the alternative upper member described previously wherein a sole pivot point is related to a series of desired width indicia ruled on the upper member.

A further feature which may be incorporated in a calculator according to the present invention allows the user to compute the necessary dimensions for laying out bumpers in the calculated stalls. Referring again to FIG. 3, there is shown a scale 100 along the edge 60, emanating from the zero length line 62 and graduated in terms of lineal measure, in the instant case feet and inches. Use of this scale is illustrated in FIG. 1 where it is shown that with the calculator set up to solve a particular problem, the scale 100 crosses the axis 40 to define a point 101 on the scale 100, in the present example read as 3 feet-4 inches. This dimension is transferred to the lot to define what may be termed a forward bumper line in the following manner. A pair of points 102, 103 are marked out along opposed stall lines 89, 89*a*, the 3 feet-4 inch dimension 101 being set out from the base line 81 along the stall line to define the points 102, 103. A chalk line is then snapped connecting these points to define a forward bumper line 104. Chalk lines 105 are then snapped from the intersection of the forward bumper line 104 and the respective stall lines 89, 89*a* to the origin of the next adjacent stall line. The lines 105 thus comprise bumper lines along which the stall bumpers are centered following painting of the lot.

As shown in FIG. 3, with the illustrated upper member, a similar scale 100*a* is provided along edge 61 to allow computation of bumper dimensions when using the apertures 35–39. For the sake of simplicity, the scale 100*a* is not shown in FIG. 1.

It will now be appreciated that what has been achieved is a calculator which not only simplifies the laying out of parking lot stalls, but also increases the accuracy with which such stalls may be laid out. Guesswork with regard to setting up angles is eliminated, and all dimensions are laid out on orthogonal axes, and may be set up using no more than a measuring tape.

I claim as my invention:

1. A calculator for laying out stalls in parking lots comprising a first member having first and second orthogonal numerical scales corresponding to stall length and width, pivot means at the origin of said scales, angular indicia at predetermined angular intervals emanating from said origin; a second member engageable with said pivot means and having a length scale thereon for selecting a desired stall length, width indicia perpendicularly related to said length scale for selecting a desired stall width, and alignment indicia emanating from said engaged pivot means for selecting a desired stall angle; said second member being pivotable about said pivot means for aligning said alignment indicia with a selected one of said angular indicia on said first member for establishing the desired stall angle, whereupon the length scale and width indicia on said second member intersect said length and width scales of said first member to read the orthogonal dimensions of stall length and width to achieve the desired stall length and width at the desired angle.

2. A calculator for laying out parking lot stalls to calculate orthogonal dimensions for length and width to achieve a desired stall length and width at a desired angle comprising a first member having a pair of orthogonal axes and pivot means at the origin thereof, length and width scales emanating from said origin and along respective ones of said axes to form a grid over at least a portion of said member, desired angle indicia emanating from said origin at respective angular increments toward said grid; a second member having a plurality of pivot points individually associatable with said pivot means, reference means on said second member for associating said pivot points with respective ones of said desired stall widths, said pivot points falling in a zero length line, desired length scale means on said second member parallel to said zero length line related to respective ones of said desired stall lengths, alignment indicia on said second member emanating from respective ones of said pivot points and being perpendicular to said desired length scale means, individual ones of said pivot points being associatable with said pivot means on said first member for establishing a desired stall width, lining up of the alignment indicia of the selected width pivot point with the desired stall angle on said first member causing said desired width and length means of said second member to intersect said width and length scales of said first member to read the orthogonal dimensions of stall length and width to achieve the desired stall length and width at the desired angle.

3. The calculator as set forth in claim 2 wherein said reference means on said second member crosses the width axis of said first member to indicate the repetitive stall width.

4. The calculator as set forth in claim 2 wherein said alignment indicia of the selected width pivot point and said desired stall length scale intersect at a point defining in said grid the orthogonal stall length and partial stall width for laying out said desired angle.

5. The calculator as set forth in claim 4 wherein said reference means on said second member crosses the width axis of said first member to indicate the repetitive stall width.

6. The calculator as set forth in claim 2 wherein said second member further includes bumper scale means along said reference means and having an origin at said zero length line, said bumper scale means intersecting the width scale of said first member to calculate a forward bumper line dimension for facilitating layout of bumpers in said stalls.

* * * * *